US007114293B2

(12) United States Patent
Purlee

(10) Patent No.: US 7,114,293 B2
(45) Date of Patent: Oct. 3, 2006

(54) MAGNETIC DOOR SWEEP AND MAGNETIC THRESHOLD ASSEMBLY

(75) Inventor: Gary A. Purlee, Sellersburg, IN (US)

(73) Assignee: Holm Industries, Inc., Scottsburg, IN (US)

( * ) Notice: Subject to any disclaimer, the term of this patent is extended or adjusted under 35 U.S.C. 154(b) by 0 days.

(21) Appl. No.: 10/991,355

(22) Filed: Nov. 17, 2004

(65) Prior Publication Data

US 2006/0101719 A1 May 18, 2006

(51) Int. Cl.
*E06B 1/70* (2006.01)

(52) U.S. Cl. ..... 49/470; 49/469

(58) Field of Classification Search ..... 049/467, 049/469, 470, 478.1
See application file for complete search history.

(56) References Cited

U.S. PATENT DOCUMENTS 2,611,158 A 9/1952 Gregory
3,604,152 A 9/1971 Protzman
4,185,417 A * 1/1980 McKann ..... 49/470
4,300,314 A * 11/1981 Dittrich ..... 49/470
4,413,446 A * 11/1983 Dittrich ..... 49/470
4,702,038 A * 10/1987 Frey ..... 49/478.1
5,150,544 A 9/1992 Burnett
5,309,680 A * 5/1994 Kiel ..... 49/478.1

FOREIGN PATENT DOCUMENTS

EP 0 451 732 A2 * 4/1991

* cited by examiner

*Primary Examiner*—Jerry Redman
(74) *Attorney, Agent, or Firm*—Harness, Dickey & Pierce, P.L.C.

(57) ABSTRACT

A magnetic door sweep and magnetic threshold is disclosed which reliably aligns and seals to prevent water, air and pests from crossing the threshold of a door. Additionally, the magnetic door sweep and magnetic threshold will prevent shape loss of the door sweep. The magnetic door seal includes a primary seal and a door seal magnetic element having a first set of poles located on the bottom edge of a door. A magnetic threshold includes a threshold cap and a threshold magnetic element having a second set of poles. The door seal is positionable relative to the threshold as the door is closed such that the first set of poles is attracted to the second set of poles when said door seal is positioned proximate to the threshold allowing the primary seal to extend between the door and the threshold.

18 Claims, 3 Drawing Sheets

MAGNETIC DOOR SWEEP AND MAGNETIC THRESHOLD ASSEMBLY

FIELD OF THE INVENTION

The present invention relates to door sweeps and door thresholds. More specifically, the invention relates to a magnetic door sweep and a magnetic threshold whose magnets have specifically arranged polarities to create a controlled magnetic seal between the door sweep and the threshold.

BACKGROUND OF THE INVENTION

The major parts of a door sealing system consist of a door sweep, which is located at the bottom of most entry doors to assist in sealing the bottom of the door, and a threshold cap, which makes contact with the door sweep to seal and help prevent water, air and pests from passing beyond the threshold. While current door sealing systems have generally proven to be satisfactory for their applications, each is associated with its share of limitations.

One major limitation of many current door sealing systems relates to their inability to consistently form a consistent seal due to variation between the door and the threshold throughout the life of the door seal. Due to current designs, door sweeps become deformed, lose their shape and ultimately leave gaps in the seal thus compromising the integrity of the entire seal. This permits water, air and pests to pass beyond the threshold.

Another limitation of many known door sweeps is the harsh noise created by the door sweep and threshold when the doors are opened or closed. The noise is caused by the door sweep being dragged across the threshold. Additionally, this noise may be made worse by thresholds that have a grooved surface. However, door sweeps that contact thresholds upon opening have traditionally been necessary to create and maintain a seal between the door and its corresponding threshold.

Another limitation of current door sweeps and their associated thresholds is their propensity to wear through due to constant scuffing of the door sweep on the threshold. This creates a need for maintenance and as the door sweep wears, its sealing effectiveness generally diminishes.

What is needed then is a device that does not suffer from the above limitations. This in turn, will provide a device that repeatedly creates a proper seal between the door sweep and its associated threshold every time the door is opened and closed, regardless of which direction the door is opened or closed. Furthermore, a door sweep device will be provided that does not lose its shape after repeated door openings and closings. Additionally, a door sweep and its associated threshold is needed that does not make harsh noises upon every opening and closing of an associated door. Finally, a door sweep is needed that does not wear out or at least is capable of experiencing a longer life than current door sweeps. It is, therefore, an object of the present invention to provide a door sweep and threshold that achieves the above-identified advantages.

SUMMARY OF THE INVENTION

In accordance with the teachings of the present invention, a magnetic door sweep and magnetic threshold are provided that reliably align and seal to prevent water, air and pests from crossing the threshold of a door. Additionally, the magnetic door sweep and magnetic threshold will prevent shape loss of the door sweep. The magnetic door seal includes with a primary seal and a door seal magnetic element having a first set of poles located on the bottom edge of a door. A magnetic threshold includes a threshold cap and a threshold magnetic element having a second set of poles. The door seal is positionable relative to the threshold as the door is closed such that the first set of pole are attracted to the second set of poles when said door seal is positioned proximate to the threshold allowing the primary seal to extend between the door and the threshold.

Continuing with advantages, the magnetic door sweep and magnetic threshold will prevent dragging of the door sweep across the threshold which will, in turn, prevent undesirable noise from emanating from the door sweep area and prevent abrasive wearing of the sweep jacket, which will prolong the life of the sweep jacket.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

Figure 1:
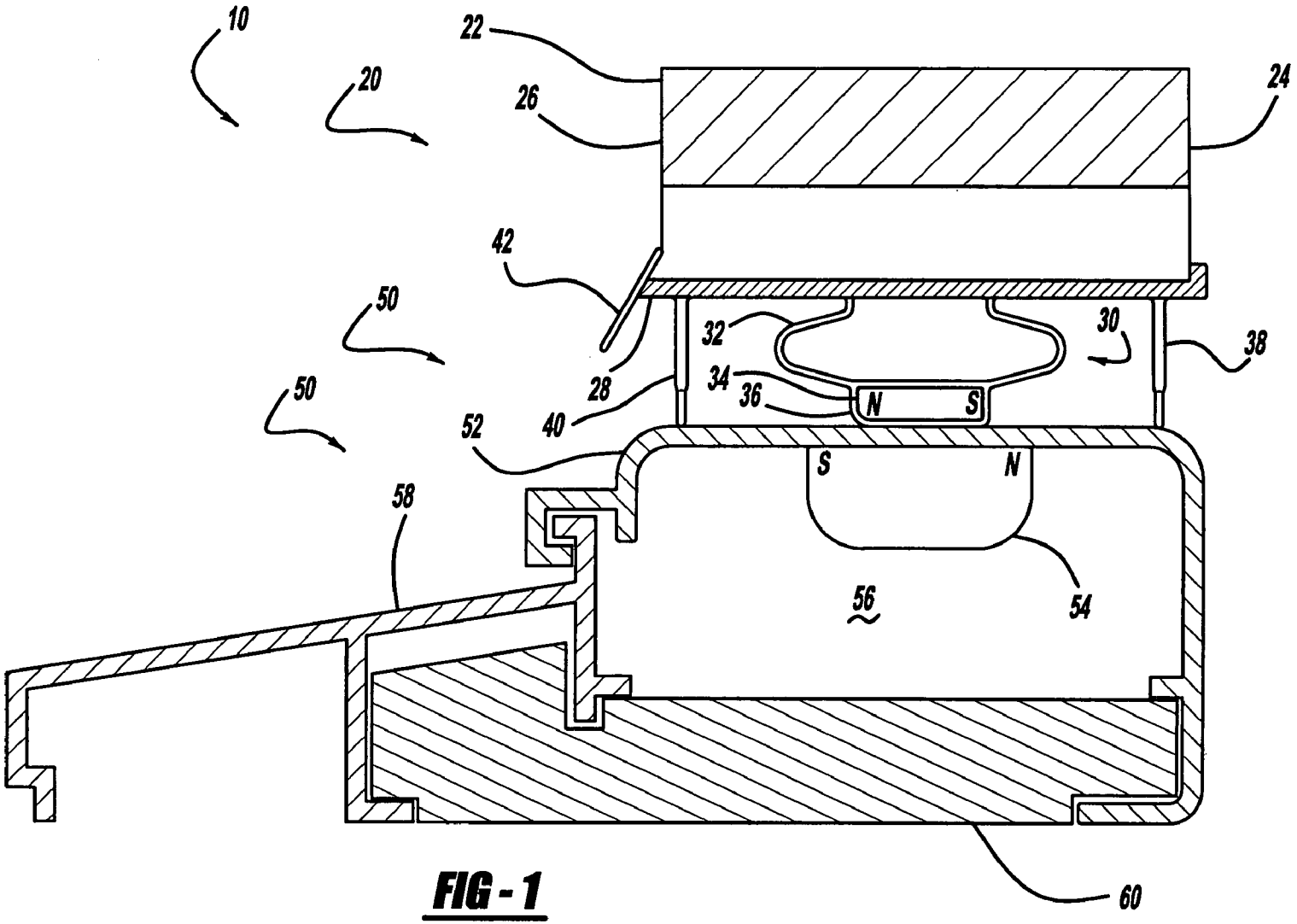
FIG. 1 is a cross-sectional view of a door sweep and threshold showing the polar arrangements of a door sweep magnet and a door threshold magnet according to teachings of the present invention.

The following description of the preferred embodiment is merely exemplary in nature and is in no way intended to limit the invention, its application, or uses. FIG. 1 depicts a cross-sectional view of a magnetic door sweep and a magnetic threshold 10 according to teachings of the present invention. The magnetic door sweep and magnetic threshold 10 has a magnetic door sweep 20 and a magnetic threshold 50. Turning to the magnetic door sweep 20, a door 22 has a door sweep base plate 28 attached along a bottom edge thereof. The door 22 has an inside surface 24 and an outside surface 26, which respectively represent the inside of a building and an outside of a building. Attached to the door sweep base plate 28 is a door seal 30, which has a flexible bellows 32 attached to a magnet 34. As presently preferred, magnet 34 is a bar magnet having a north pole "N" along one longitudinal edge and a south pole "S" along opposite longitudinal edge. The magnet 34 may be covered with a jacket 36 that is made of a material that is suitable for sealing such as rubber or plastic.

In addition to the door seal 30, the magnetic door sweep 20 has an inside sweep seal 38 and an outside sweep seal 40. These seals 38, 40 provide aesthetic appeal since they shield the door seal 30 from the view of door users and they act as an additional level of sealing from wind, water, pests, etc. Since the inside sweep seal 38 and the outside sweep seal 40 may minimally touch the threshold cap 52, or reach to just above the threshold cap 52, they are effective in their purpose of sealing and providing aesthetic value to the magnetic door sweep and magnetic threshold 10. Attached to the outside portion of the door sweep base plate 28 is a base plate shield 42, which is provided for aesthetic qualities as it blocks the view of the door seal 30.

With continued reference to FIG. 1, the magnetic threshold 50 will be explained. The magnetic threshold 50 has a threshold cap 52 and a magnet 54 that is attached within the interior volume 56 of threshold cap 52 by an adhesive or mechanical fastener such as a screw. Alternately, the threshold cap 52 may have an interior support formed within the interior volume thereof to support the magnet 54. As presently preferred, magnet 54 is a bar magnet having a north pole "N" and a south pole "S" which are positioned in an opposite orientation relative to the poles of magnet 34. The width between the poles of magnet 54 is greater than the width between the poles of magnet 34. In this way, magnet 34 and the door seal 30 is generally centered over the magnet 54 in the threshold 50. Thus, a positive seal between the door 22 and the threshold 52 can be assured. The threshold cap 52 is supported by a door plate 58 and a door sill 60. The door plate 58 is located on the outside of a building and is typically aluminum but can be made of a ferrous metal, wood or other material capable of withstanding the repeated weight of door users. The door sill 60 is typically wood, but can be made of plastic or other material capable of withstanding the repeated weight of door users. The door sill 60 provides added support to the door plate 58 and threshold cap 52.

With continued reference to FIG. 1, the sealing of the magnetic door sweep and magnetic threshold 10, when the door 22 is in its closed and sealed position, will be explained. In this closed position, a magnetic seal is created because of the opposed positioning of the polarities of the magnets 34, 54 when the door is in its closed position. As can be seen in FIG. 1, the north pole "N" of the top magnet 34 is proximate to and attracted to the south pole "S" of the bottom magnet 54. Additionally, the south pole "S" of the top magnet 34 is attracted to the north pole "N" of the bottom magnet 54. Between the north pole "N" and the south pole "S" of the top magnet, exists a transitional range of polarity strength from the north pole to the south pole. That is, as the distance from the north pole to the south pole increases, the strength of the north pole decreases and the strength of the south pole increases.

With respect to the top magnet 34, the maximum strength of the north pole "N" is at the inside edge of the top magnet 34, that is, at the outside side of the bellows 32, while the maximum strength of the south pole "S" is at the outside edge of the top magnet 34, that is, at the inside side of the bellows 32. The inside side and outside side of the bellows 32 is equivalent to the inside surface 24 of the door 22 and the outside surface 26 of the door 22. The same relationship is true of the bottom magnet 54, although the maximum strength of the south pole "S" is at the outside edge of the bottom magnet 54 and the maximum strength of the north pole "N" is at the inside edge of the bottom magnet 54. The inside seal 38 and the outside seal 40 generally do not move during the opening and closing of the door 22. The seals 38, 40 provide an extra level of protection at the bottom of the door 22 against airflow. They also provide aesthetic aspect to the magnetic door sweep and magnetic threshold 10 by shielding the magnetic door sweep and magnetic threshold 10 from the view of door users.

Figure 2:
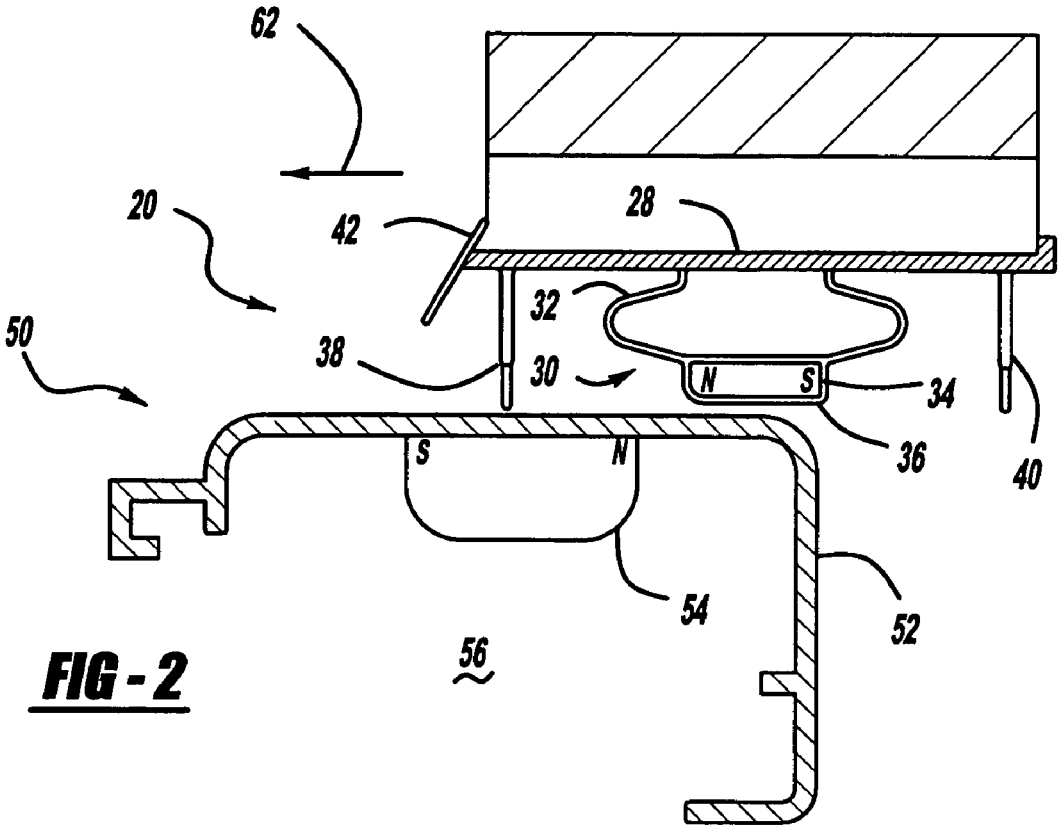
FIG. 2 is a cross-sectional view of a door sweep and threshold in a situation in which the door sweep is approaching the threshold according to teachings of the present invention.

With reference to FIGS. 2 through 5, the process of sealing when the door moves from an open position to its closed and sealed position, will be explained. FIG. 2 is a cross-sectional view of a magnetic door sweep 20 and a magnetic threshold 50 in a situation in which the door 22 is closing and the door seal 30 is approaching the magnetic threshold 50 according to teachings of the present invention. With reference to FIG. 2, the magnetic door sweep 20 moves in the direction of arrow 62 toward its closed position. The closed position of the door 22 and its associated door seal 30 occurs when the magnetic door sweep 20 is directly above the magnetic threshold 50, as seen in FIG. 1. Continuing with reference to FIG. 2, as the magnetic door sweep threshold 20 moves, the door seal 30 with its top magnet 34 is still in a retracted position due to the memory of the bellows 32. That is, the top magnet is unaffected by the magnetic force of the bottom magnet 54 of the magnetic threshold 50. The retracted position of the door sweep 30, and more specifically, the flexible bellows 32 and top magnet 34, is in its natural suspension position when it is unaffected by any magnetic forces. FIG. 2 shows such a position.

Figure 3:
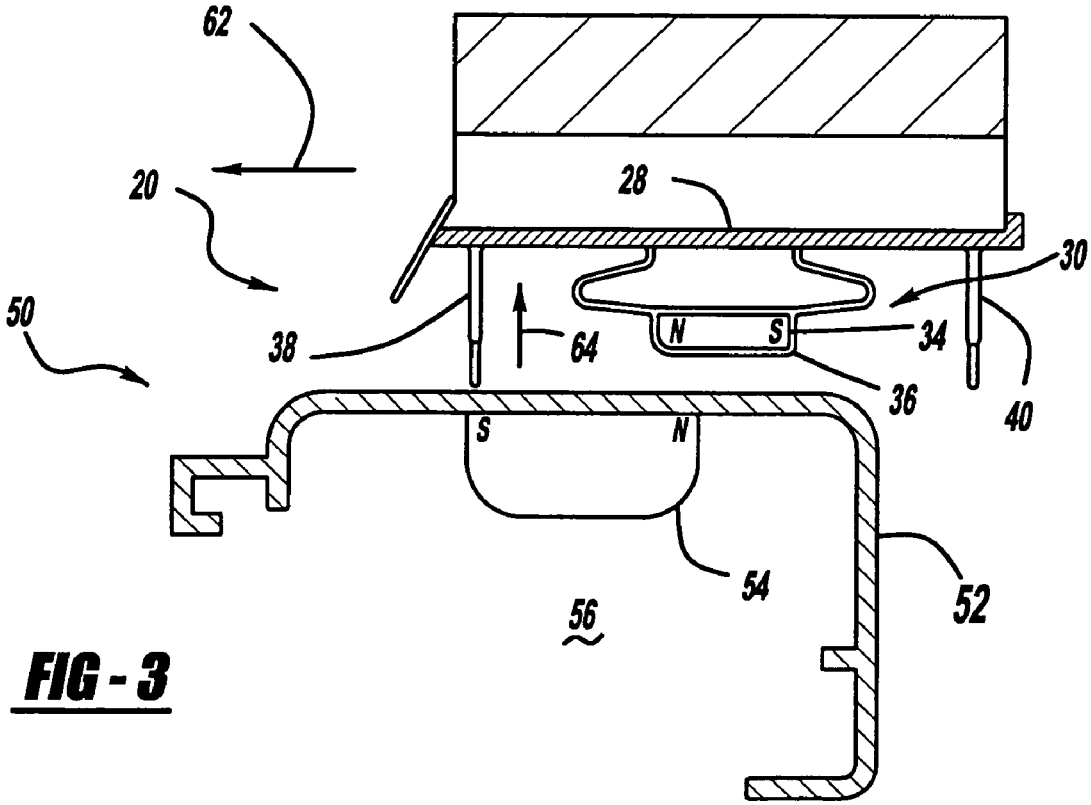
FIG. 3 is a cross-sectional view of a door sweep and threshold in which the door sweep is at its maximum height over the threshold according to teachings of the present invention.

FIG. 3 is a cross-sectional view of a magnetic door sweep 20 and a magnetic threshold 50 in which the door seal 30 is at its maximum height over the magnetic threshold 50 according to teachings of the present invention. As the magnetic door sweep 20 approaches the magnetic threshold 50 according to the direction of motion noted by arrow 62, the door seal 30 is pushed upwardly from the repelling force of the north pole "N" of the top magnet 34 when located directly over or proximate to the north pole "N" of the bottom magnet 54. This repelling force causes the flexible bellows 32 of the door seal 30 to contract in the direction noted by arrow 64. When the door seal 30 contracts, the jacket 36 surrounding the top magnet 34 does not contact the threshold cap 52, which provides several advantages. The advantages of the jacket 36 not contacting the threshold cap 52 is that there is no noise generated, which normally occurs when a door sweep contacts or is dragged across a threshold, and there is no wearing of the jacket 36, which normally occurs when the jacket 36 would otherwise contact the threshold cap 52. The contraction of the bellows 32 and lifting of the door seal 30 above the threshold cap 52 continues as the magnetic door seal 30 moves over the magnetic threshold 50.

Figure 4:
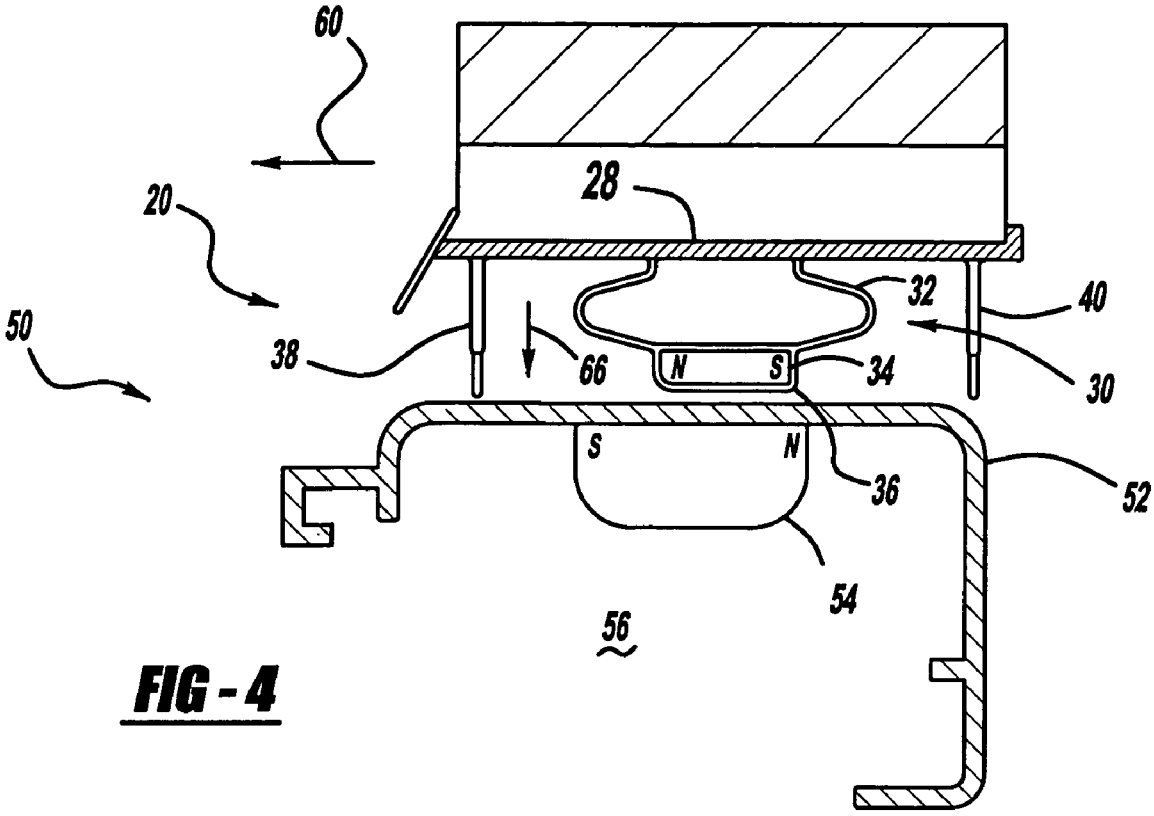
FIG. 4 is a cross-sectional view of a door sweep and threshold in which the door sweep is nearly in its final position over the threshold before sealing according to teachings of the present invention.

FIG. 4 is a cross-sectional view of a magnetic door seal 30 and a magnetic threshold 50 in which the door seal 30 is approaching its sealing position over the threshold cap 52 and bottom magnet 54 according to teachings of the present invention. FIG. 4 depicts a situation in which the magnetic door seal 30 continues moving in the direction of arrow 60. As the magnetic door seal 30 continues to move, the position of the top magnet 34 is different than it was in FIG. 3, with respect to the bottom magnet 54. In FIG. 4, the top magnet 34 is closer to its sealing position. This means that the door seal 30 has begun its decent toward the threshold cap 52. This is caused by the changing attraction between the top and bottom magnets 34, 54.

In FIG. 4, the north pole "N" of the top magnet 34 is approaching or proximate to the south pole "S" of the bottom magnet 54, and the south pole "S"of the top magnet 34 is approaching or proximate to the north pole "N" of the bottom magnet 54. The locations of the magnets 34, 54 in FIG. 4 create a magnetic attraction force between the magnets 34, 54. Therefore, the door seal 30 begins moving in the direction of arrow 66 causing the bellows 32 to begin to open, expand or reach toward the threshold cap 52. At the same time, the magnetic door seal 30 continues to move in the direction of arrow 62, which causes an increase in the attraction forces due to continued alignment and positioning of the magnetic polarities.

Figure 5:
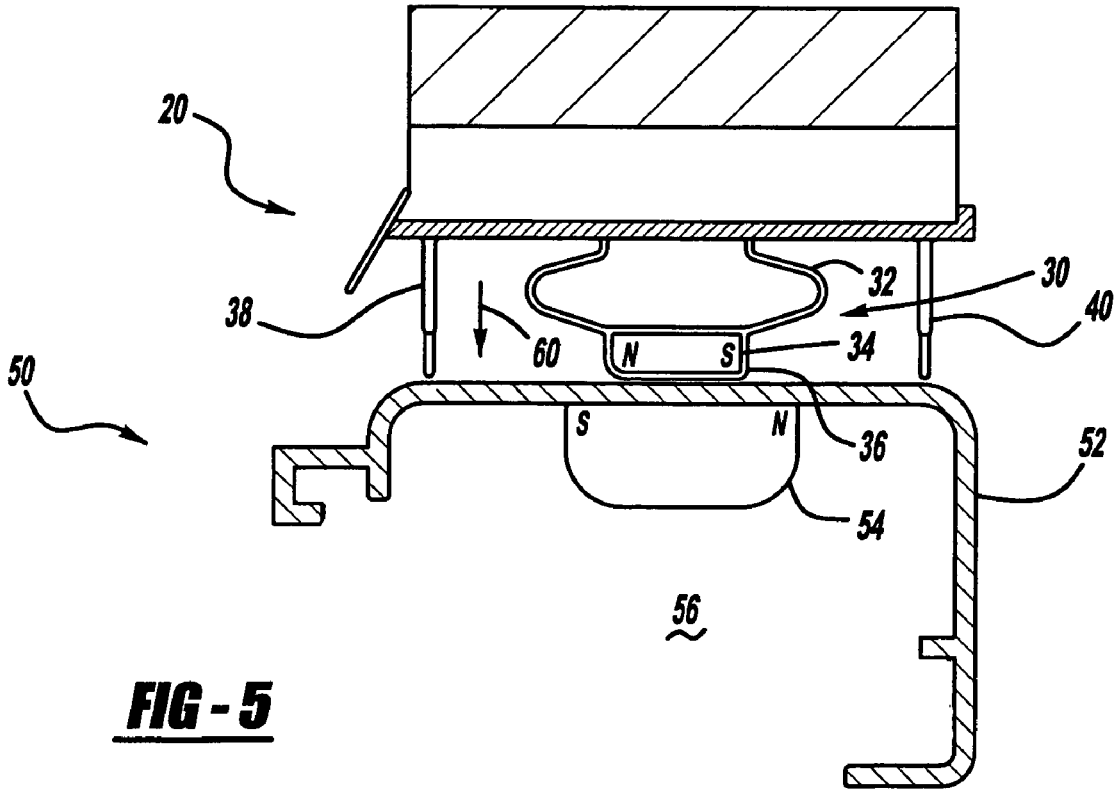
FIG. 5 is a cross-sectional view of a door sweep and threshold in which the door sweep is in its sealed position over the threshold according to teachings of the present invention.

FIG. 5 is a cross-sectional view of a magnetic door seal 30 and a magnetic threshold 50 in which the door seal 30 is in its sealed position on the threshold cap 52 according to teachings of the present invention. At the position shown when the door seal 30 is on the threshold cap 52, the jacket 36 on the top magnet 34 contacts the threshold cap 52. In this position, the bellows 32 is fully extended in the direction noted by arrow 66. Additionally, the distance between the corner north pole "N" of top magnet 34 and the corner south pole "S" of the bottom magnet 54 is equal to or nearly equal to the distance between the corner south pole "S" of the top magnet 34 and the corner north pole "N" of the bottom magnet 54. Thus, the magnet 34 and hence the door seal 30 is generally centered over the magnet 54 and threshold cap 52.

The magnetic attraction created by the specific positioning of the polarities of the magnets 34, 54 creates a magnetic attraction between the top magnet 34 and bottom magnet 54 that seals the jacket 36 of the door seal 30 to the top surface of the threshold cap 52. Since the contact seal of the jacket 36 and the top surface of the threshold cap 52 does not occur until the above-explained positioning of magnetic polarities occurs, there is no other contact between any of the parts. Because of this, there is no noise associated with the door seal 30 and threshold cap 52 upon closing the door. Additionally, because there is no dragging contact before the jacket 36 seals with the threshold cap 52, there is no associated wearing of the parts. The door seal 30 essentially reaches out to the threshold cap 52 when the desired magnetic polarity alignment has occurred, and causes a head-on magnetic contact between the top magnet 34, which is surrounded by the jacket 36, and the bottom magnet 54, which is covered by the threshold cap 52.

Upon opening of the door, the magnetic door sweep 20 works in a generally reverse order to that described above. The magnet force holding the door seal 30 against the threshold cap 52 is overcome by the opening force of the door 22. As the magnet 34 moves relative to the magnet 54, the polarity of the magnets 34, 54 causes the seal to be urged away from the threshold 50, thereby unsealing the door 22 from the threshold 50.

The description of the invention is merely exemplary in nature and, thus, variations that do not depart from the gist of the invention are intended to be within the scope of the invention. For example, the preferred embodiment is described as having a set of bar magnets. However, one skilled in the art will recognize that other magnetic elements may be employed in the present invention. In this regard, discrete magnet elements could be incorporated into the threshold cap in place of the singular bar magnet. Such variations are not to be regarded as a departure from the spirit and scope of the invention.

What is claimed is:

1. A magnetic door sweep comprising:

a door seal including a base member having a bellows elastically supporting a first magnet at an intermediate location below said base member, said first magnet having a first set of poles in which opposite poles are spaced apart at a first distance; and a threshold having a stationary threshold cap and a second magnet disposed beneath said stationary threshold cap, said second magnet having a second set of poles in which opposite poles are spaced apart at a second distance that is greater than said first distance;

wherein said first set of poles are repelled from said second set of poles when said door seal is positioned away from said stationary threshold cap retracting said bellows upward from said intermediate location, and wherein said first set of poles are attracted to said second set of poles when said door seal is positioned proximate to said stationary threshold cap centering said first magnet over said second magnet and extending said bellows downward from said intermediate location such that said door seal engages said stationary threshold cap.

2. The magnetic door sweep of claim 1 further comprising:

a first north pole and a first south pole associated with said first set of poles; and a second north pole and a second south pole associated with said second set of poles;

wherein said first north pole is proximate to said second south pole and said second north pole is proximate to said first south pole when said door seal is positioned proximate to said stationary threshold cap.

3. The magnetic door sweep of claim 1 wherein said stationary threshold cap defines an interior volume, said second magnet being located within said interior volume.

4. The magnetic door sweep of claim 1 wherein said first magnet comprises a bar magnet having a first pole along a first longitudinal edge and a second pole along a second longitudinal edge.

5. The magnetic door sweep of claim 4 wherein said second magnet comprises a bar magnet having a first pole along a first longitudinal edge and a second pole along a second longitudinal edge.

6. The magnetic door sweep of claim 1 wherein said bellows comprises a pair of flexible sidewalls extending from said base member and terminating at said first magnet.

7. The magnetic door sweep of claim 1 further comprising a door plate extending from said threshold.

8. The magnetic door sweep of claim 1 further comprising a sweep seal extending from said base member adjacent said bellows.

9. The magnetic door sweep of claim 1 further comprising a pair of sweep seals extending from said base member, said bellows interposed between said pair of sweep seals.

10. The magnetic door sweep of claim 1 further comprising a plate shield formed along an edge of said base member.

11. A door assembly comprising:

a door supported within a door opening and positionable between an open position and a closed position, said door having an edge formed thereon;

a threshold having a stationary threshold cap spaced apart from said edge when said door is in said closed position and a threshold magnet disposed beneath said stationary threshold cap and having a first set of poles in which opposite poles are spaced apart at a first distance; and a door seal on said edge, said door seal having a base member with a bellows elastically supporting a seal magnet at an intermediate location below said edge, said seal magnet having a second set of poles in which opposite poles are spaced apart at a second distance that is greater than said first distance;

wherein said second set of poles are attracted to said first set of poles centering said first set of poles over said second set of poles when said door is in said closed position, extending said bellows downward from said intermediate location, and wherein said second set of poles are repelled from said first set of poles when said door is in said open position, retracting said bellows upward from said intermediate position.

12. The door assembly of claim 11 wherein said stationary threshold cap defines an interior volume within which said threshold magnet is disposed.

13. The door assembly of claim 11 wherein said threshold magnet comprises a bar magnet having a first pole along a first longitudinal edge and a second pole along a second longitudinal edge.

14. The door assembly of claim 13 wherein said seal magnet comprises a bar magnet having a first pole along a first longitudinal edge and a second pole along a second longitudinal edge.

15. The door assembly of claim 14 wherein said first pole of said seal magnet is a north pole and said second pole of said seal magnet is a south pole, and said first pole of said threshold magnet is a north pole and said second pole of said threshold magnet is a south pole, and wherein said first pole of said seal magnet is proximate to said second pole of said threshold magnet and said first pole of said threshold magnet is proximate to said second pole of said seal magnet centering said seal magnet over said threshold magnet when said door seal is positioned proximate to said threshold.

16. The door assembly of claim 11 wherein said bellows comprises a pair of flexible sidewalls extending from said base member toward said seal magnet.

17. The door assembly of claim 11 further comprising a pair of sweep seals extending from said base member, said seal magnet disposed between said pair of sweep seals.

18. A magnetic door sweep comprising:

a first sealing member having a flexible bellows, said flexible bellows elastically supporting a first magnet at an intermediate location below said first sealing member, said first magnet comprising a bar magnet having a north pole along a first longitudinal edge and a south pole along a second longitudinal edge in which opposite poles are spaced apart at a first distance; and a stationary threshold sealing member having a threshold magnet disposed therein, said threshold magnet comprising a bar magnet having a south pole along a first longitudinal edge and a north pole along a second longitudinal edge in which opposite poles are spaced apart at a second distance that is greater than said first distance;

wherein said north pole of said first magnet is attracted to said south pole of said threshold magnet and said south pole of said first magnet is attracted to said north pole of said threshold magnet when said first sealing member is positioned proximate to said stationary threshold sealing member centering said first magnet over said second magnet and, said flexible bellows extending downward toward said threshold sealing member, thereby forming a seal between said first sealing member and said stationary threshold sealing member, and wherein one of said north pole and said south pole of said first magnet is repelled by one of said south pole and said north pole of said second magnet when said first sealing member is positioned away from said threshold sealing member, retracting said flexible bellows upwards.

* * * * *